US006964171B2

(12) United States Patent
Li et al.

(10) Patent No.: US 6,964,171 B2
(45) Date of Patent: Nov. 15, 2005

(54) METHOD AND APPARATUS USING JETS TO INITIATE DETONATIONS

(75) Inventors: Chiping Li, Arlington, VA (US); Kazhikathra Kailasanath, Laurel, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 56 days.

(21) Appl. No.: 10/662,170

(22) Filed: Sep. 11, 2003

(65) Prior Publication Data

US 2005/0058957 A1 Mar. 17, 2005

(51) Int. Cl.[7] ..... F02C 5/00

(52) U.S. Cl. ..... 60/772; 60/39.76; 60/39.821; 60/247; 431/1

(58) Field of Search ..... 60/247–249, 772, 60/39.38–39.4, 39.76–39.81; 431/1

(56) References Cited

U.S. PATENT DOCUMENTS 2,689,454 A * 9/1954 Schneider ..... 60/39.826
2,708,341 A * 5/1955 Zucrow ..... 60/39.821
2,758,441 A * 8/1956 Kalil et al. ..... 60/39.826
3,175,357 A * 3/1965 Klein ..... 60/249
3,263,418 A * 8/1966 Lange et al. ..... 60/247
3,321,920 A * 5/1967 Walter et al. ..... 60/247
3,545,211 A * 12/1970 Harp, Jr. ..... 60/247
4,642,046 A * 2/1987 Saito et al. ..... 60/39.76
5,615,548 A * 4/1997 Winfree et al. ..... 60/247
5,800,153 A * 9/1998 DeRoche ..... 60/39.77
5,937,635 A * 8/1999 Winfree et al. ..... 60/39.78
6,584,765 B1 * 7/2003 Tew et al. ..... 60/247
6,748,735 B2 * 6/2004 Schmotolocha et al. . 60/39.821

* cited by examiner

*Primary Examiner*—Ted Kim
(74) *Attorney, Agent, or Firm*—John J. Karasek; George A. Kap

(57) ABSTRACT

This invention pertains to apparatus and method for initiating detonation in a chamber of tubular or other shapes, which can be a combustor for a propulsion engine, such as a pulse detonation engine. This invention is characterized by detonation initiation at high pressure and temperature that is generated by imploding shocks induced by jets in different directions around the chamber. Further, the detonation initiation is achieved without energy depositing devices, such as electric spark plugs and lasers and without any fuel or other chemical additives.

21 Claims, 12 Drawing Sheets

(8 of 12 Drawing Sheet(s) Filed in Color)

METHOD AND APPARATUS USING JETS TO INITIATE DETONATIONS

BACKGROUND OF THE INVENTION

1. Field of the Invention

This invention pertains to detonation initiation in a combustible material by imploding shocks generated by impinging jets in a chamber defined as combustor filled with the combustible material.

2. Description of Related Art

Detonation is a very efficient combustion process that couples chemical energy release to shock waves, generating extremely high pressures. Therefore, propulsion devices based on detonation can operate at higher pressure levels, hence, greater propulsion efficiency than conventional propulsion engines based on the constant-pressure combustion process such as flame or deflagration. Among the detonation-based propulsion devices, the pulse detonation engine looks particularly promising. Pulse detonation engine is a propulsion device using the high pressure generated by repetitive detonation waves in a combustible material. For most pulse detonation engines, the operating frequency is 50 Hz to 1000 Hz, corresponding to operating cycle time of 0.02 to 0.001 seconds. Detonation initiation in pulse detonation engines is one of the most challenging problems in the development of pulse detonation engines.

Traditional methods of detonation initiation, such as direct initiation or deflagration to detonation transition, are impractical for practical pulse detonation engine applications. In the direct initiation process, a significant amount of energy is applied to the combustible material by energy-depositing devices, such as high-power spark plugs or lasers, to directly initiate detonation. However, the amount of energy required for direct initiation of the conventional combustible material used in pulse detonation engines is impractically large . In the deflagration to detonation transition process, a small amount of energy is used to ignite a flame or deflagration in the combustible material which later transitions into a detonation as it propagates through the combustible material. The main difficulty with using deflagration to detonation transition for pulse detonation engine applications is that the transition distance is too long for a practical pulse detonation engine system.

There have been persistent efforts to overcome the initiation difficulty by either lowering the initiation energy requirement in the direct initiation process or reducing the transition distance in the deflagration to detonation transition process. Internal blockages or obstacles, such as spirals, have been introduced into the pulse detonation engine tube to shorten the deflagration to detonation transition distance with limited success. However, the blockage parts in the pulse detonation engine tube negatively impact the pulse detonation engine performance and significantly complicate the engine configuration. Another approach is to use chemical additives, such as oxygen or very energetic hydrocarbons, to reduce the initiation energy requirement to a level that can be provided by practical energy-depositing devices, such as spark plugs or lasers. However, carrying additional fuel additives is undesirable for aviation applications.

U.S. Pat. No. 5,473,885 to Hunter et al is entitled "Pulse Detonation Engine" describes a pulse detonation engine which has a detonation chamber with a sidewall and two fuel ports located in the sidewall. In this design, an oxygen-fuel mixture is introduced through the forward port and detonated, creating a detonation wave propagating into an air-fuel mixture introduced through the rearward port. This patent primarily focuses on the pulse detonation cycle and detonation tube and related valve structures.

U.S. Pat. No. 5,800,153 to DeRoche entitled "Repetitive Detonation Generator" describes an apparatus and method for generating detonation waves. In the patented apparatus, the detonation is generated by electric spark plugs in a tube. However, besides showing some spark plugs in the system schematics, the patent neither provides any specifics on the spark plug ignition system in particular nor makes any claim in methods or devices for detonation initiation in general.

U.S. Pat. No. 5,937,635 to Winfree et al entitled "Pulse Detonation Igniter for Pulse Detonation Chambers" describes a pulse detonation engine with a pulse ignition system and a plurality of detonation chambers. The main feature of this design is the use of the igniter for multiple detonation tubes or chambers. The ignition system comprises several small tubes and detonation waves are initiated in oxygen-enriched mixture in those tubes by electric spark plugs or lasers. The major disadvantages of this design include system complication and the high power requirement by electric spark plugs or laser energy depositor; additional system complications for handling the added oxygen, which is especially disadvantageous to aviation engines; and difficulties during detonation transition from a small initiation tube, where the detonation is generated by spark plug or a laser, to a detonation tube of a larger size. During the transition, the detonation may fail.

Reference paper AIAA 02-3627 entitled "Initiation Systems for Pulse Detonation Engines," by Jackson and Shepherd describes a initiation method in which multiple small detonations arm combined to a focusing region to generate a detonation covering the entire pulse detonation engine tube. However, in this approach, the small detonations are still needed to be initiated by spark plugs and a complex tubing system is required to synchronize arrival times of the small detonations at the focusing region.

OBJECTS AND BRIEF SUMMARY OF THE INVENTION

It is a primary object of this invention to initiate detonations in combustible materials for detonation-based devices, such as pulse detonation engines.

Another object of this invention is a method and apparatus to initiate detonations in combustible materials by means of high pressure and temperature generated by imploding shocks generated by impinging jets.

It is another object of this invention to initiate detonation in combustible materials without using any fuel additives or additional fuel components such as pure- oxygen or any additional fuel components, which are different from the combustible material.

It is another object of this invention to initiate detonation in a combustible material without using any electric, optical or other similar forms of energy depositing devices such as spark plugs and/or lasers, which are complex and require a great amount of power.

These and other objects of this invention can be attained by admitting jet material into a chamber filled with combustible material to generate imploding shocks which initiate detonations in the combustible material.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

In the color figures, color purple-blue indicates initial pressure of 1 atmosphere (about 1 bar) and absence of water, which is a combustion reaction product. Color green indicates medium to high pressure of about 5–25 atmospheres. Color yellow represents pressure values ranging from about 25–30 atmospheres and color red represents pressure exceeding 30 atmospheres. The sequential figures show appearance of the reaction product water where its concentration is quantitatively indicated by the respective colors.

DETAILED DESCRIPTION OF THE INVENTION

The intent of the present invention is to use the high pressure and temperature produced by imploding shocks generated by impinging jet or jets introduced from different directions into a chamber, such as the pulse detonation engine tubular combustor. When the jets impinge, imploding shocks are generated and produce high temperature in the collision region. If the pressure and temperature are high enough and the high-pressure-temperature region is large enough, a detonation can be initiated.

Figure 1:
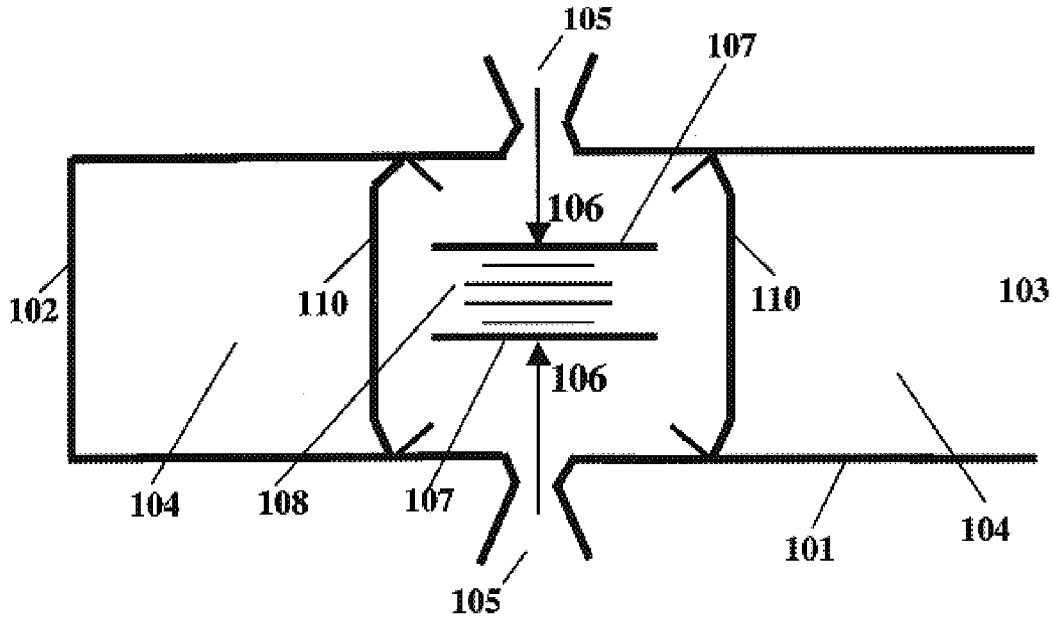
FIG. 1 is a schematic illustration of the scientific principle of this invention showing a single circumferential, annular impinging jet through a slot-shaped opening in a tubular chamber filled with a combustible material with an exit opening at one end, i.e., the open end, and a wall at the opposite end, i.e., the closed end, where the imploding shock generated by the impinging jet generates a region of very high pressure and temperature near the collision center away from the closed end where a detonation, defined as a shock wave coupled with combustion, is initiated in the combustible material in the chamber.

FIG. 1 is a schematic of the scientific principle of this invention. As an example, a pulse detonation engine tube chamber 101 with a closed end wall 102 and an open end or exit 103 is filled with a combustible material 104. The chamber can be of any other geometric shape. The chamber, when tubular, can be straight and/or curved, with or without branches, with a constant or a changing cross-section of various shapes, with one or more than one open ends, and with end walls of various shapes. Through a circumferential nozzle or slot 105 located in the middle of the tube and protruding through the tube wall, a circumferential, impinging jet 106 is introduced. The jet material can be any substance in gaseous, liquid or solid form. This jet can either be fuel, oxidizer, inert material or any combination thereof. The most preferred jet material is air and in this case, no additional fuel components are needed. This impinging jet 106 generates an imploding shock 107 which in turn produces high-pressure-temperature imploding region 108 and detonation is initiated from the high-pressure-temperature region and the resulting detonation forms two fronts 110 propagating in both directions toward the closed end 102 and the open end 103. The embodiment of FIG. 1 is characterized by location of circumferential slot 105 at a distance approximately equally removed from closed end 102 and the open end 103 so that shock and other pressure wave reflections from either end do not affect detonation initiation process.

Figure 2:
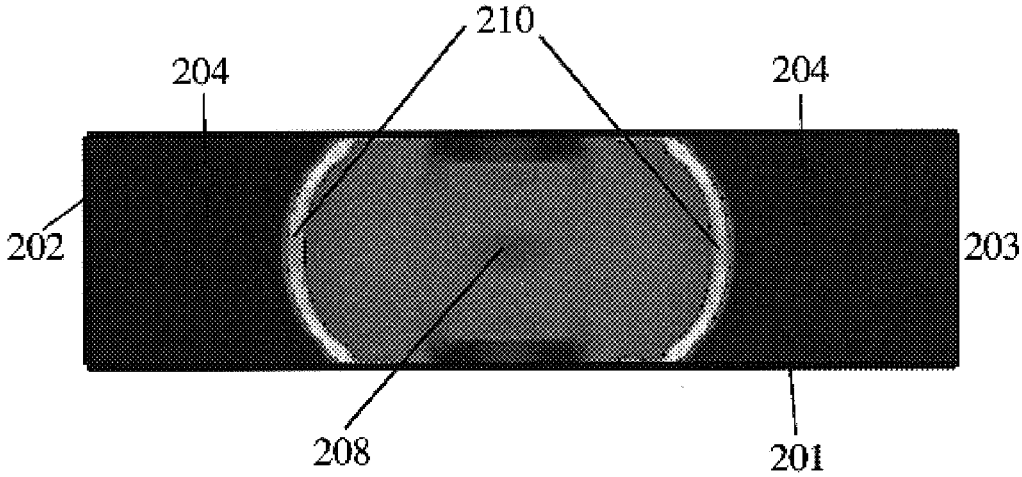
FIG. 2 illustrates the expanding detonation fronts, based on operation of the embodiment of FIG. 1 with the detonation fronts moving in opposite directions unencumbered by reflected shocks or other pressure waves from either closed or open ends.

FIG. 2 illustrates flow features of the embodiment of FIG. 1 in a detonation initiation process created by the impinging jet in the combustible material 204 which is introduced into chamber 201 through slot 205. The two yellow detonation fronts 210 expand outwardly to the closed end wall 202 and to the open-end exit 203 from the imploding region 208.

Figure 3:
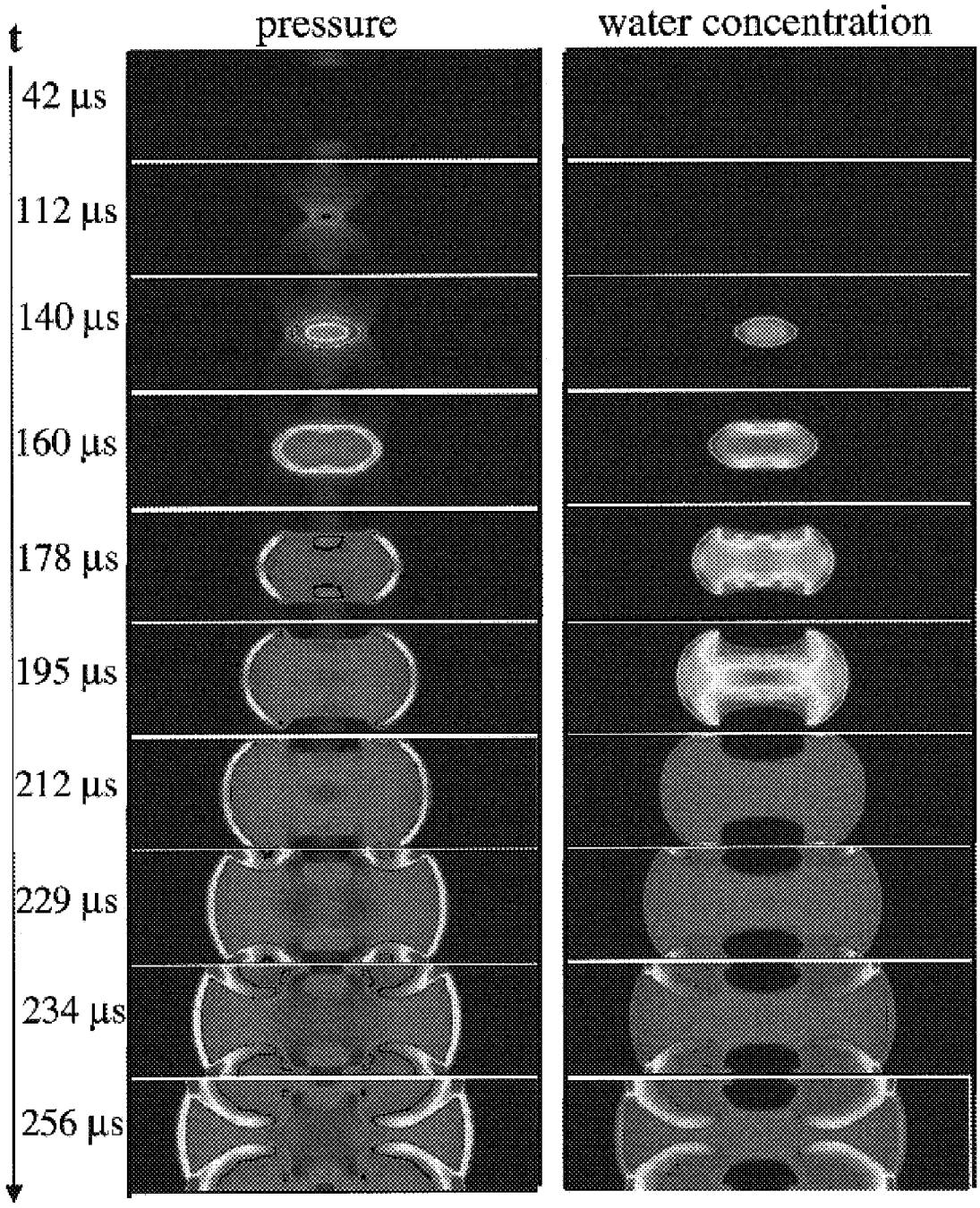
FIG. 3 illustrates sequential progression of a typical detonation initiation process-in a device design which is-described in the embodiment of FIG. 1 using one annular air jet at pressure of 2.0 bars, temperature of 250 K and Mach number of unity. The combustible material in the chamber is the ethylene-air stoichiometric mixture ($C_2H_4$:$O_2$:$N_2$/1:3:11.28).

FIG. 3 is a more specific showing of the detonation initiation process of the embodiment of FIG. 1. At 42 $\mu$s, the pressure shows the jet material entering the chamber preceded by the jet-induced imploding shock. At 112 $\mu$s, the imploding shock collides in the center region of the tube and a high-pressure-temperature region begins to form. The purple-blue color in the figure indicates the unburned combustible material. Detonation initiation initially appears on the pressure side in the frame at 140 $\mu$s in the form of an orange elliptical form. On the water side, presence of combustion products is confirmed in the 140 $\mu$s frame by existence of water represented orange/red region that coincides with the high pressure region. Frames 160 $\mu$s to 256 $\mu$s in FIG. 3 show expansion of the detonation front and underlying combustion process through the tube cross section to the tube wall. In this case, detonation is fully initiated before 195 $\mu$s and therefore, the detonation initiation time is less than 195 $\mu$s.

Figure 4:
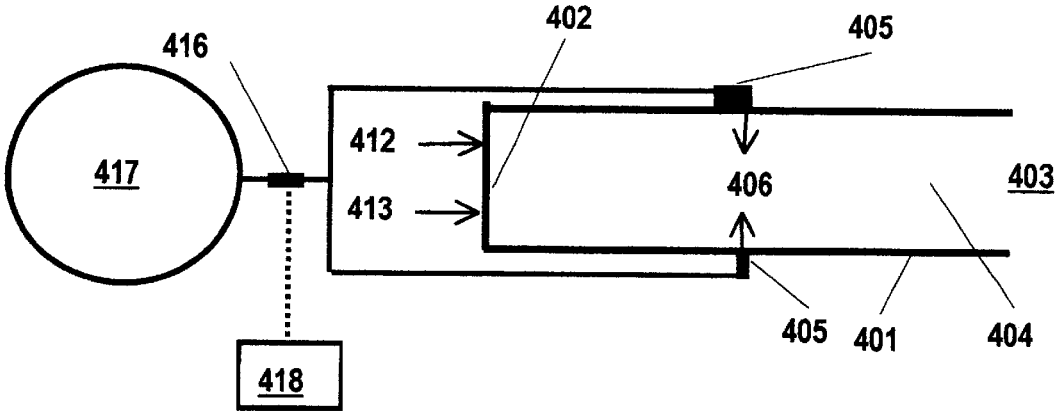
FIG. 4 is a schematic illustration of typical generic apparatus showing the annular jet and a tank holding the jet material under pressure.

A typical generic design of the apparatus is shown in FIG. 4. The combustible material is a gaseous fuel-air mixture that is injected through separate air and fuel ports 412 and 413 in the closed-end wall 402 into the pulse detonation engine tube chamber 401. After the fuel and air are sufficiently mixed or premixed beforehand to form a combustible material that is present in chamber 401, a circumferential imploding jet 406 of air for detonation initiation is introduced through the circumferential nozzle or slot 405 and it collides forming a high pressure temperature region where detonation was initiated. The initiated detonation wave propagates through the entire chamber and gradually consumes all the combustible material in the tube. Eventually, the combustion products are moved out of the tube through chamber open exit end 403 and the tube is refilled with air and fuel through 412 and 413 and the process starts over again.

Through a control valve 416, the nozzle is connected to tank 417, where the jet material is stored at a given pressure. Control valve 416 is controlled by an electronic control unit 418 which opens the valve to start injecting the jet material into the chamber. After the detonation is initiated or any time before next cycle starts, the control unit 418 shuts-off valve 416 to stop the flow of the jet material. After detonation propagates through the mixture in the tube, the high pressure generated in the detonation process pushes the combustion products out of the tube. Fresh fuel and air are introduced into the tube through the air and fuel ports and the process repeats itself. All this can be achieved by pre-setting the time interval to open and close the valves or controlling the valve according to the pressure in the pulse detonation engine tube.

Figure 5:
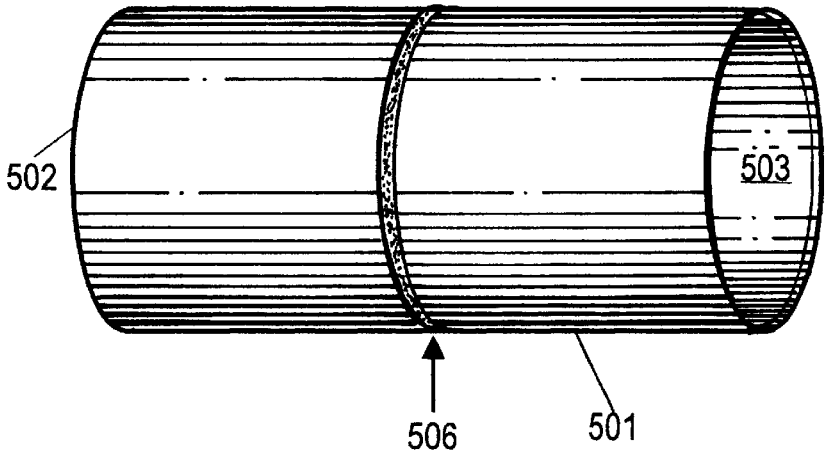
FIG. 5 is a schematic illustration of a tubular chamber with a single circumferential continuous slot in the chamber wall disposed about midway between the open and closed ends of the chamber, the slot serving the purpose for introducing the jet material into the chamber.

FIG. 5 illustrates placement of circumferential slot 506, through which jet material 506 passes, about midway of the chamber 501 between the closed-end wall 502 and open-end exit 503. Openings on the tube wall for the jet can be in different shapes and be placed anywhere on the chamber wall.

Figure 6:
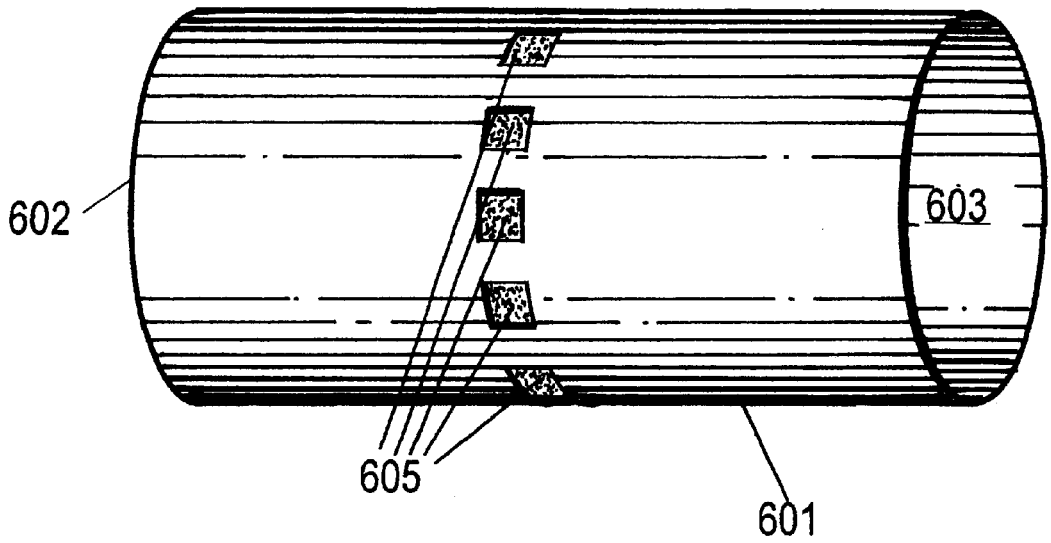
FIG. 6 illustrates a tubular chamber and multiple evenly-spaced openings in the chamber wall for admitting a jet material into the chamber to initiate detonation in the combustible material that is in the chamber.
Figure 7:
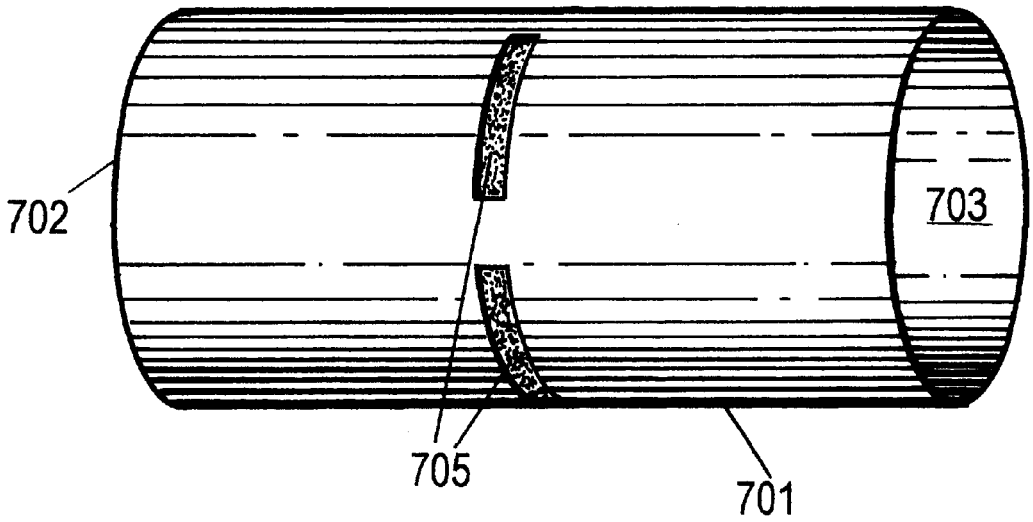
FIG. 7 illustrates another form of evenly spaced discontinuous openings which are in the form of elongated slots in the chamber wall for admitting a jet material into the chamber to initiate detonation in a combustible material that is in the chamber.

FIG. 6 illustrates multiple jet openings 605 in chamber tube 601 about midway between the closed-end 602 and open end 603 of the chamber. Although approximately square openings 605 are shown in FIG. 6, it should be understood that the openings can be of any suitable size and geometric shapes FIG. 7 illustrates discontinuous elongated slots 705 in chamber tube 701 disposed about midway between the closed-end wall 702 and open-end exit 703.

Figure 8:
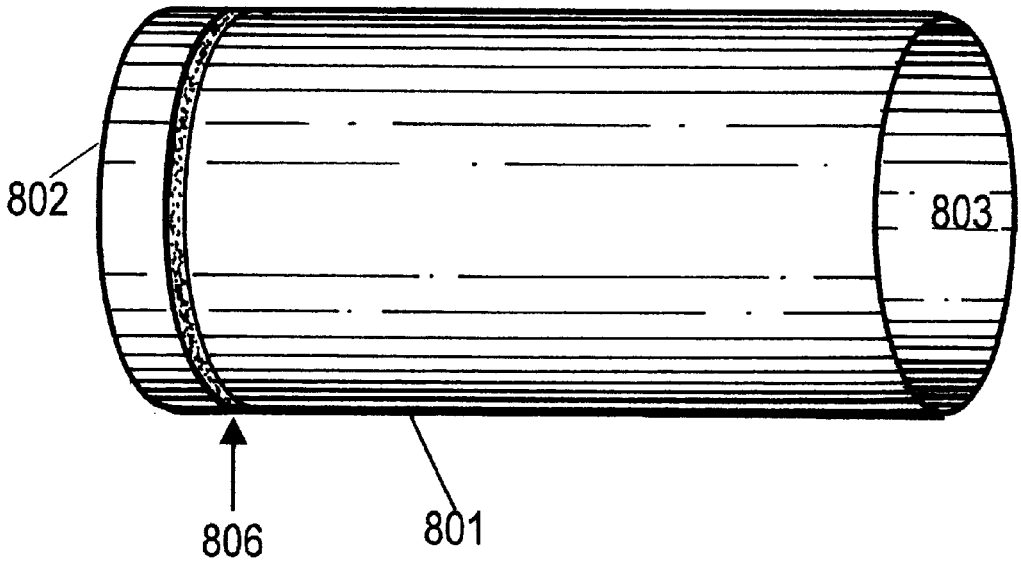
FIG. 8 illustrates circumferential slot in the chamber wall located a short distance from the closed end of the chamber.

FIG. 8 illustrates a single continuous circumferential slot 806 disposed close to the closed-end wall 802 of chamber tube 801.

Figure 9:
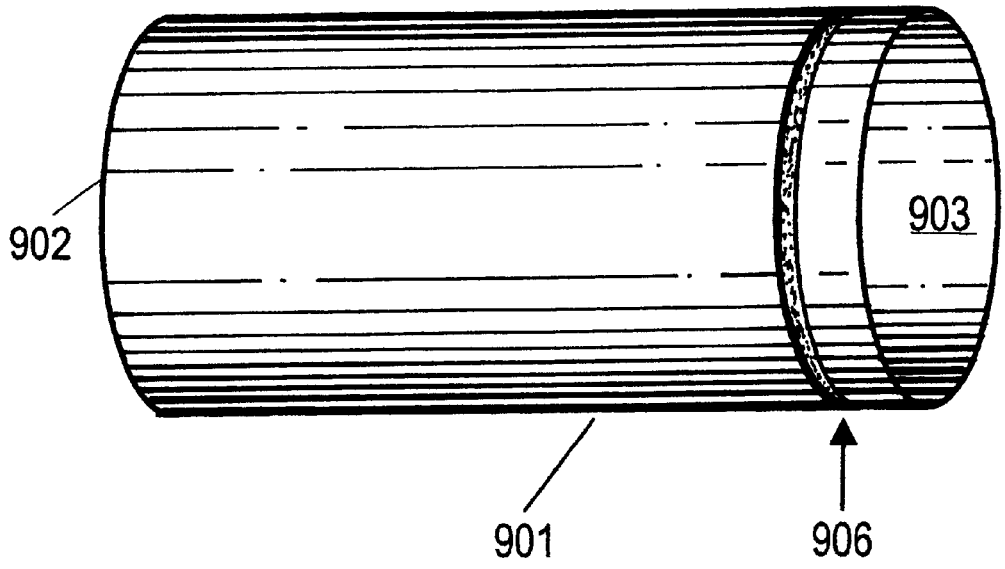
FIG. 9 illustrates circumferential slot in the chamber wall located at a small distance from the open end or exit of the chamber.

FIG. 9 illustrates a single continuous circumferential slot 906 disposed close to open exit end 903 of chamber tube 901.

Figure 10:
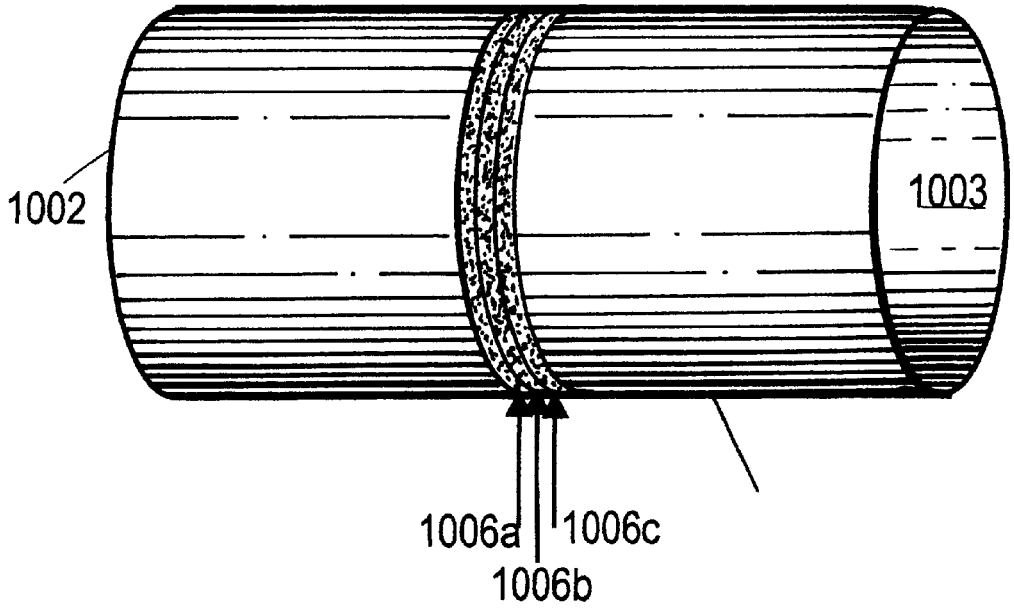
FIG. 10 illustrates three circumferential slots disposed together in the chamber wall at about the middle of the chamber between its closed end and its open exit.

FIG. 10 illustrates circumferential slots 1006*a*, 1006*b*, and 1006*c* disposed in the chamber wall about midway between the closed-end wall 1002 and open-end exit 1003 of chamber tube 1001.

Figure 11:
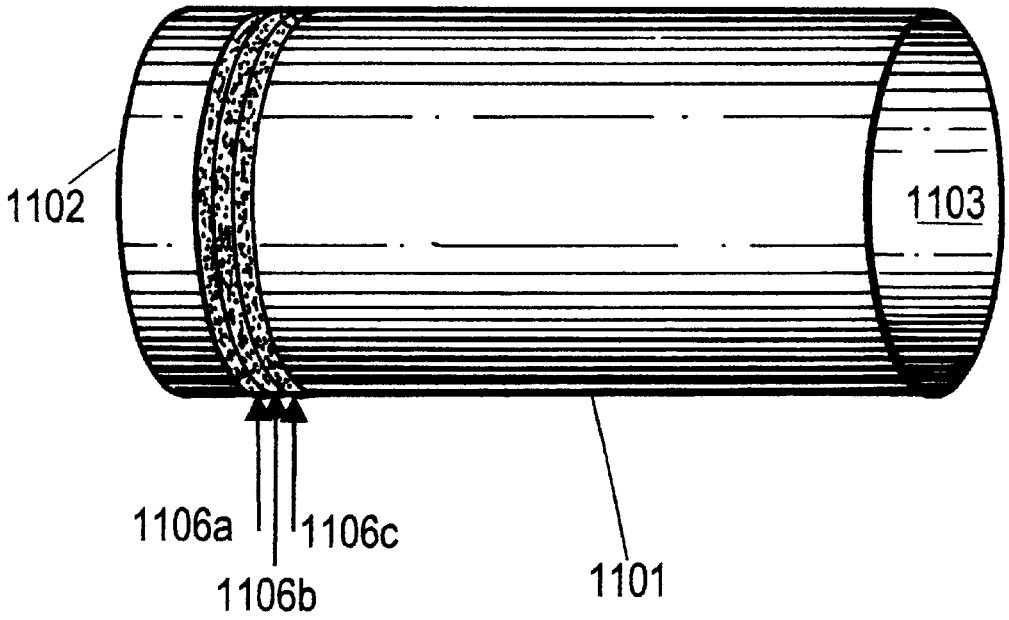
FIG. 11 illustrates three circumferential slots disposed together in the chamber wall disposed close to its closed end but spaced therefrom.

FIG. 11 illustrates slots 1106*a*, 1106*b*, and 1106*c* disposed close to the closed-end wall 1102 of the chamber tube 1101.

Figure 12:
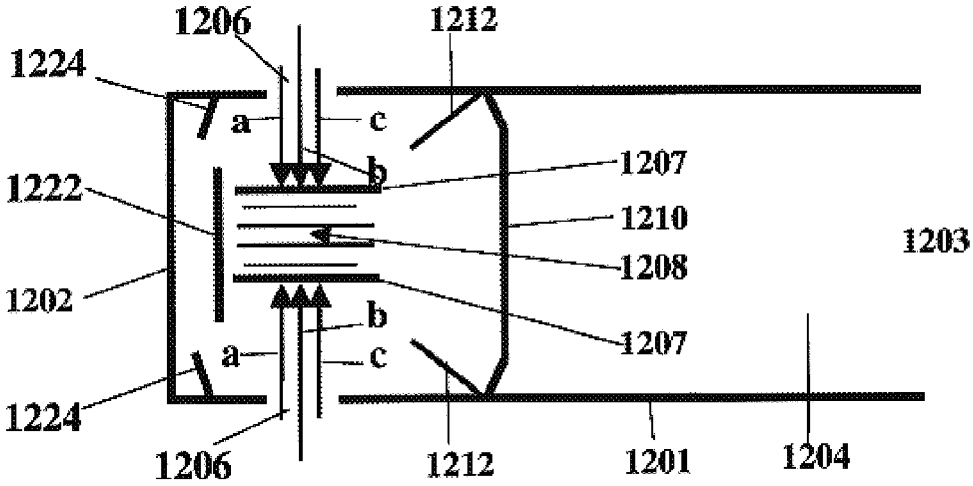
FIG. 12 is a schematic illustration of the scientific principle of using three circumferential annular, impinging jets enter a chamber through slots, creating imploding shocks generating a region of very high pressure and temperature, where detonation is initiated in the chamber, the slots through which the jet material is admitted into the chamber are disposed at a location on the chamber wall slightly removed from the closed end of the chamber.

FIG. 12 demonstrates the three-jet embodiment in greater detail. In this embodiment, alternating air jet 1206*a*, fuel jet 1206*b* and air jet 1206*c* are used to enhance the initiation process by introducing additional combustion among jet materials themselves and combustion between the jet material and combustible material already in the chamber. As in the embodiment of FIG. 1, the FIG. 12 embodiment includes tube 1201 filled with a combustible material 1204. The jet set 1206 shown in this FIG. 12 is close to the closed-end wall 1202. Jets a–c correspond to slots a–c shown in FIG. 11. In FIG. 12, the impinging air-fuel jet set 1206 creates an imploding shock 1207 which in turn generates high pressure and temperature in the central region 1208 which is augmented by reflected shock waves 1222 from the closed-end wall 1202, reflected shock waves 1224 from the tube corners and reflected shock waves 1212 from side walls, which form advancing detonation front 1210.

Figure 13:
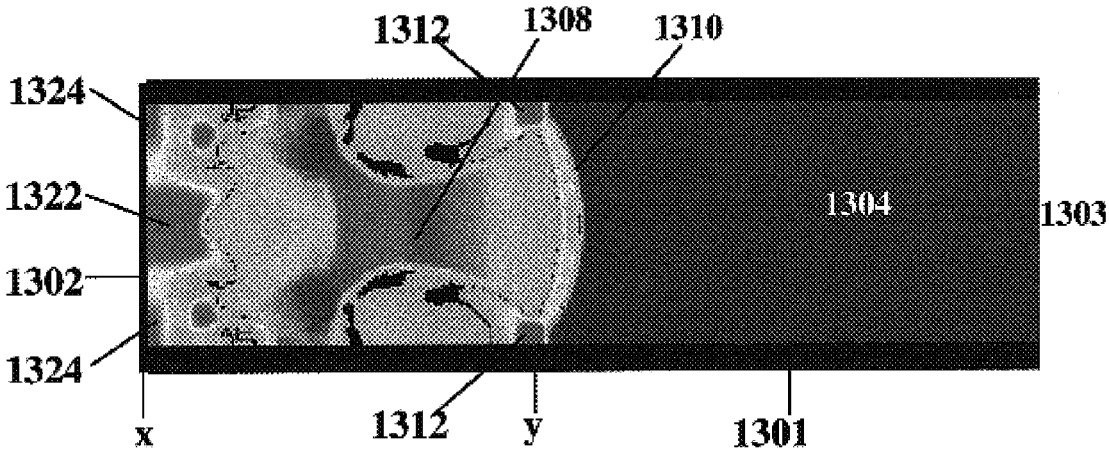
FIG. 13 illustrates flow features generated in a jet detonation initiation process created by three annular, impinging jets, as shown in FIG. 12, with the single detonation front advancing towards the open exit end of the chamber.

FIG. 13 shows important flow features at a later stage in the jet initiation process based on the FIG. 12 embodiment. This figure corresponds to the stage illustrated in FIG. 14 at 260 microseconds ($\mu$s). In FIG. 13, a detonation front 1310 has already been initiated by the impinging jets. Behind the detonation front 1310, in the region 1308 between markers x and y, the pressure is much higher than that in the unburned material 1304 and there are some important flow features: end-wall-reflected shock 1322, comer-reflected shocks 1324 and side-wall-reflected shocks 1312. These reflected shocks can serve as additional ignition sources for the detonation initiation at marginal conditions.

FIGS. 14–18 show sequential color contour plots of pressure and water distribution from several exemplary renderings based on the embodiment shown in FIG. 12 to illustrate general features in the detonation initiation process in the apparatus. In these renderings, tube diameter was 14 cm and tube length was 40 cm and the combustible material filled in the tube was a stoichiometric ethylene-air mixture of $C_2H_4$:$O_2$:$N_2$/1:3:11.28. The fuel middle jet comprised of ethylene, both of the outside oxidizer jets comprise air, width of each jet was 0.5 cm and the first air jet started at 5 cm from the end wall. In order to further enhance mixing and subsequent combustion among the jet materials and to increase the strength of reflected shock waves from the closed-end wall, the injection vector of the jets can be angled. Specifically in this case, the injection vector of the first air jet closest to the back wall was set at 30° towards the end wall. The fuel jet and the other air jets were set at 45° and 60° towards the end wall, respectively. Angling the jets does have a negative effect of reducing pressure in the central region somewhat, therefore requiring a higher pressure and/or temperature for detonation initiation.

In this case, all three jets were at the sonic or choked condition of Mach 1. The jet temperature was 360 K and jet pressure was 2.5 bars, 2.3 bars, 2.2 bars, 2.1 bars, and 2.0 bars. It is evident from this set of simulations that detonation was initiated using jet pressure of 2.1 bars or greater and detonation was not generated in the case of pressure of 2.0 or lower. This identifies the lowest jet pressure needed for detonation initiation using this jet configuration and temperature and pressure conditions. As the jet pressure decreases from 2.5 bars to 2.0 bars, where the detonation was not initiated, the initiation of detonation mechanism changes significantly and goes through three different modes, i.e., direct jet initiation, jet initiation assisted by shock reflected from the end wall, and jet initiation assisted by shocks reflected from the end wall, corner and side walls.

Figure 14:
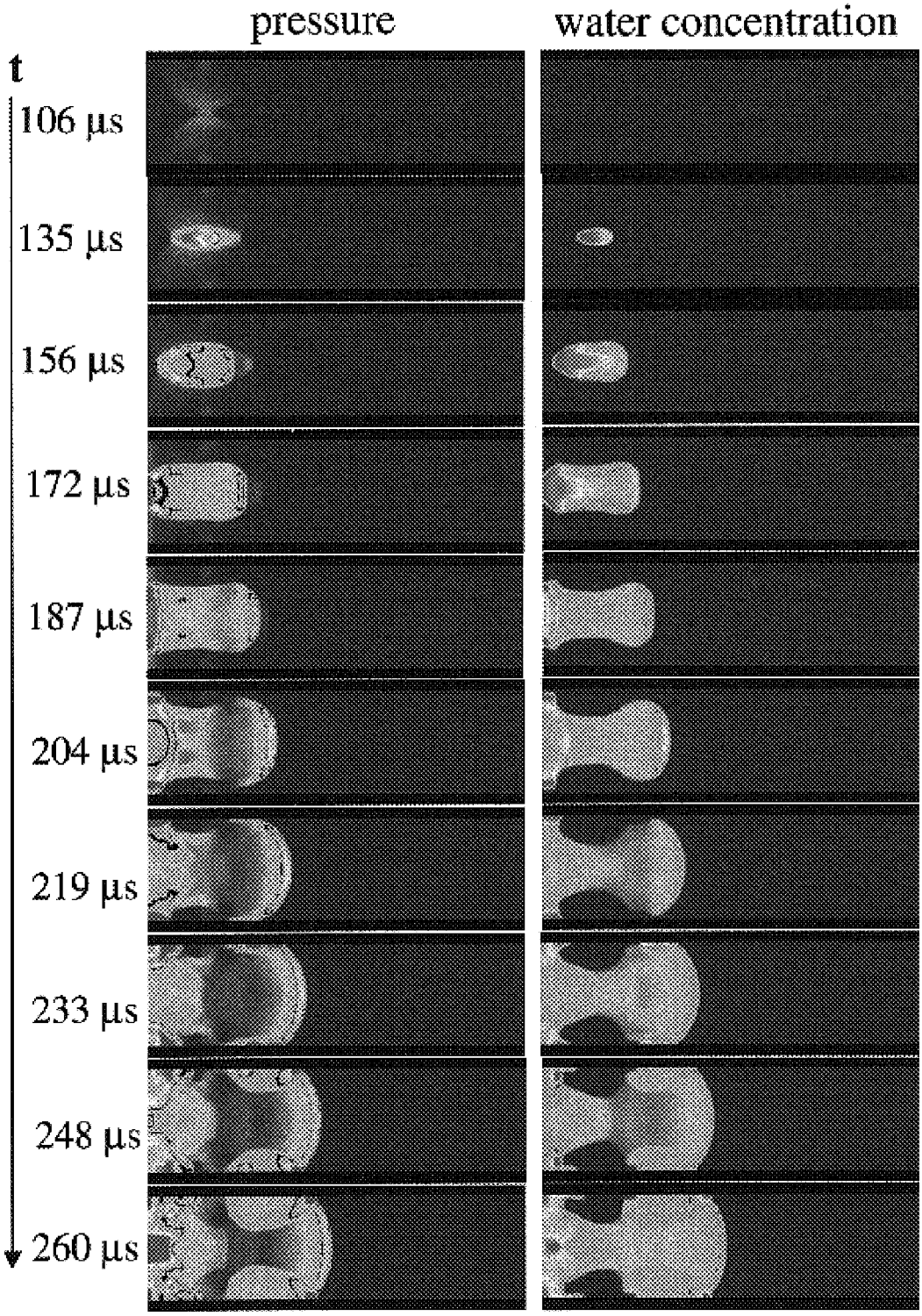
FIG. 14 illustrates incremental or sequential progression of detonation initiation to 260 $\mu$s directly by jet-induced imploding shock with the design of FIG. 12 using three jets of alternating air and fuel (ethylene) at pressure of 2.5 bars and temperature of 360 K and at a velocity of Mach number of unity.
Figure 15:
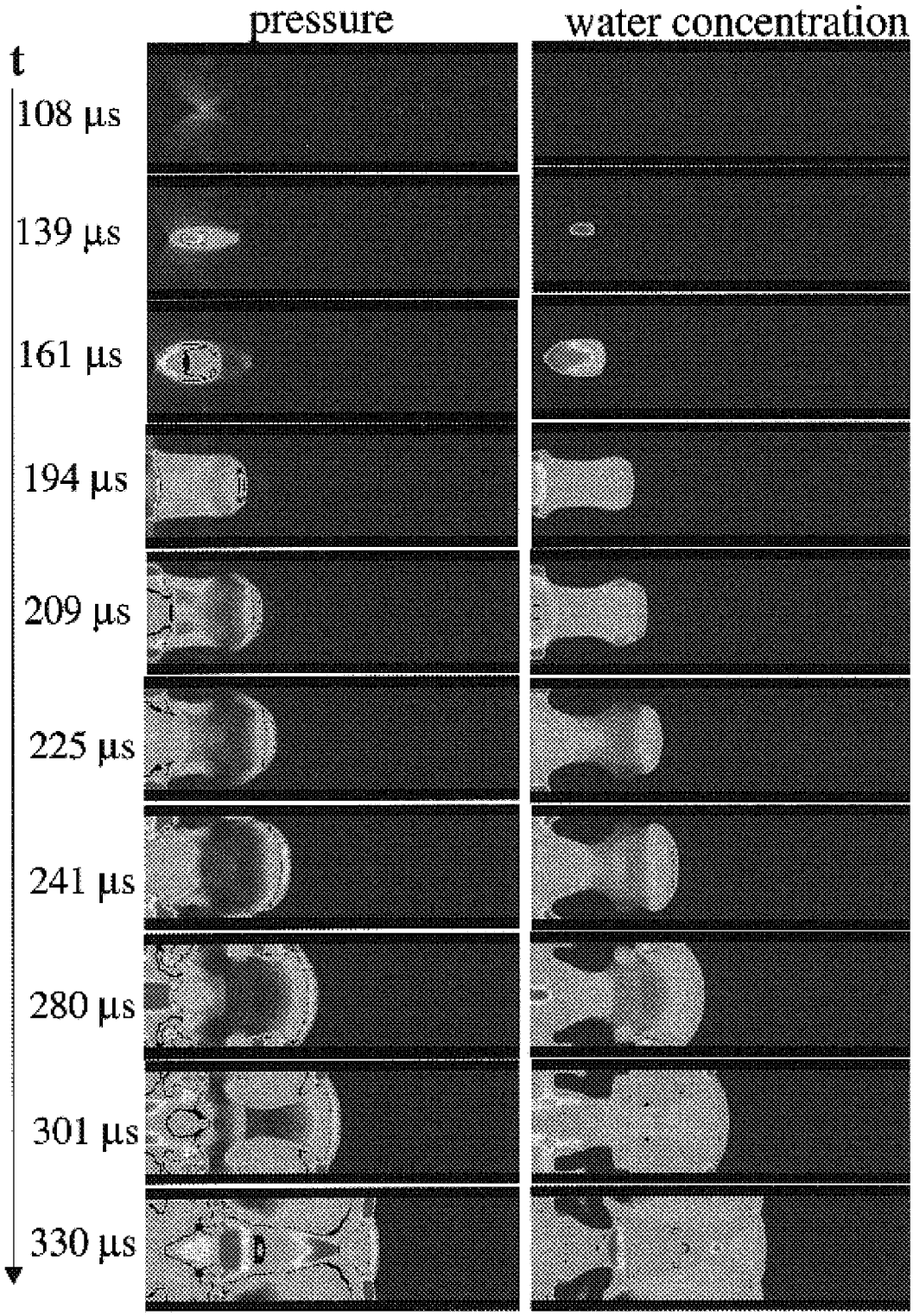
FIG. 15 illustrates incremental progression of detonation initiation to 330 $\mu$s directly by jet-induced imploding shock with the design of FIG. 12 using three jets of alternating air and fuel (ethylene) at pressure of 2.3 bars, temperature of 360 K and at a velocity of Mach number of unity.

In the case of jet pressure of 2.5 and 2.3 bars, shown in FIGS. 14 and 15, respectively, detonation was directly initiated by the high pressure and temperature in the center region of the tube where the jet-induced imploding shock concentrically collided toward the tube axis. In both cases, a high pressure region and corresponding region of water production could be seen at a very early stage. The downstream front of this region evolved into a detonation front which expanded through the entire tube. Development of the initiation process was slower in the case of 2.3 bars of jet pressure than in the 2.5 bars case due to the lower jet pressure. In both cases, the downstream front of the high-pressure-temperature region was able to become the detonation without any help from the reflected shock waves from the end wall. This also implies that detonation can be initiated by the jet of the same condition placed far away from the end wall.

More specifically, the first frame at 106 μs of FIG. 14 shows two ball-shaped cross section of the imploding shock wave that just begins to collide into itself. On the water side of the 106 μs frame, there is no water shown, which means that there was no combustion at that time since water is a product of combustion in this environment. At the 135 μs frame, there is evidence of a high pressure kernel of about 50 bars forming centrally in the tube and also formation of a small amount of water enveloped in the corresponding location. At the 156 μs frame, the high pressure kernel expands and on the water side, the orange color indicates higher water vapor concentration. At the 172 μs frame, the upstream portion of the kernel has already touched the back wall and there is evidence in the form of orange color at the end wall representing beginning formation of the reflected shock wave from the end wall. In the same frame, at the downstream or front portion of the high-pressure kernel, a detonation wave is at its inception but has not yet completely formed. At the 187 μs frame, detonation has clearly taken place, represented by the pressure jump at the downstream end of the high-pressure kernel which coincides with the jump in the water concentration at the downstream front of the kernel. At the 204 μs frame, detonation at the downstream front of the kernel expanded toward the side wall. Also, the reflected shock from the end wall was moving to the tube comer and dissipating its strength near the central part of the end wall. At the 219 μs frame, detonation further expanded, having almost reached the side walls. Eventually, the detonation reached the side wall before the 233 μs frame which shows detonation taking place in the entire tube cross-section. At the same frame, there is initial appearance of reflected shocks originated from the detonation from the side walls. At the 248 μs frame, the detonation progresses along with the reflected shock waves. At the 260 μs frame, detonation further progresses and the end-wall, comer, and side-wall shock waves can also be seen.

FIG. 15 is similar to FIG. 14 but everything is delayed because the jet pressure in the numerical experiment shown in FIG. 15 was 2.3 bars instead of 2.5 bars in the case shown in FIG. 14. With other parameters being the same, with detonation taking place in FIG. 15 at 194 μs from the start where presence of water was coupled with a pressure jump. As apparent from the figures, there is a correlation between the jet pressure and detonation initiation, with detonation initiation being delayed at lower pressures.

Figure 16:
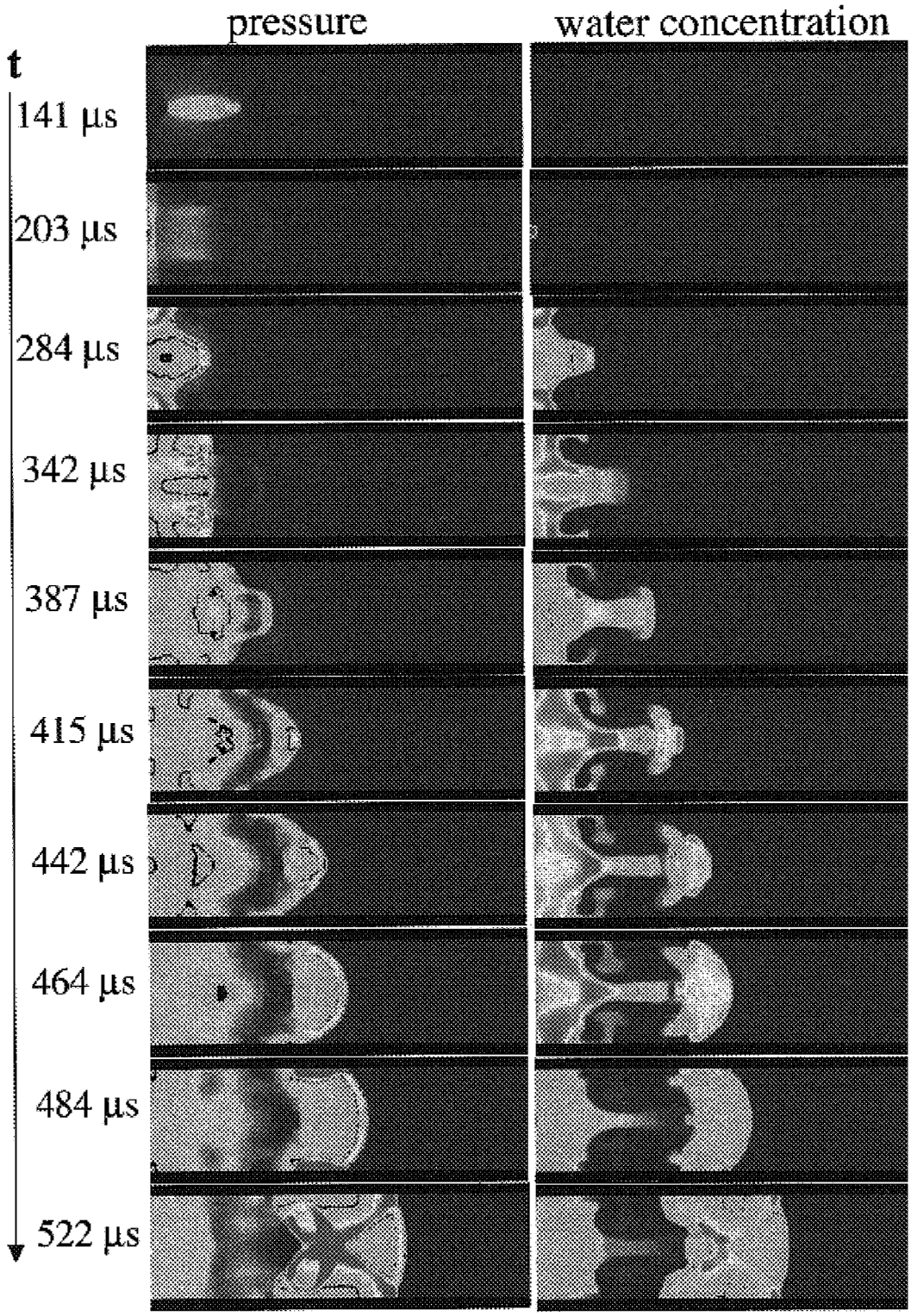
FIG. 16 illustrates incremental progression of detonation initiation to 522 $\mu$s by end-wall reflection of shock waves with the design of FIG. 12 using three jets of alternating air and fuel (ethylene) at pressure of 2.2 bars, temperature of 360 K and at velocity of Mach number of unity.

In the case of the jet pressure of 2.2 bars, shown in FIG. 16, the downstream front of the high-pressure region is not strong enough to evolve directly into a detonation front. The shock wave reflected from the end wall later becomes a detonation front and eventually reaches the tube wall. In this case, detonation is initiated by the combined strength of the initial high-pressure and temperature and those generated by the reflected shock wave from the end wall.

More specifically, from 141 μs frame of FIG. 16, there is a delay in formation of the high-pressure pressure kernel and there is no trace of combustion products such as water, as evident by the clear purple-blue frame at 141 μs frame on the water side. At the 203 μs frame, there is some evidence of combustion but the combustion did not take place near the downstream front of the high pressure kernel but took place near the center of the end wall, which coincides with the end-wall reflected shock and is caused by combined effects of the original imploding shock and the reflected shock from the end wall. At the 284 μs frame, the water region grows but the detonation has not yet been initiated until 415 μs. In 415 μs frame, there is some evidence of a pressure jump coupled with the water formation. More significant initiation of detonation takes place at the 442 As frame with the water front being coupled with pressure jump. This detonation initiation process continues through frames at 464 μs, 484 μs and 522 μs. At the 484 μs frame, the side-wall reflected shock waves appear, shown as orange sections near the detonation front. The 522 μs frame shows the side-wall reflected shock waves expanding but in this case, where the jet pressure is 2.2 bars, the side-wall reflected shock waves are not needed for the detonation initiation.

Figure 17:
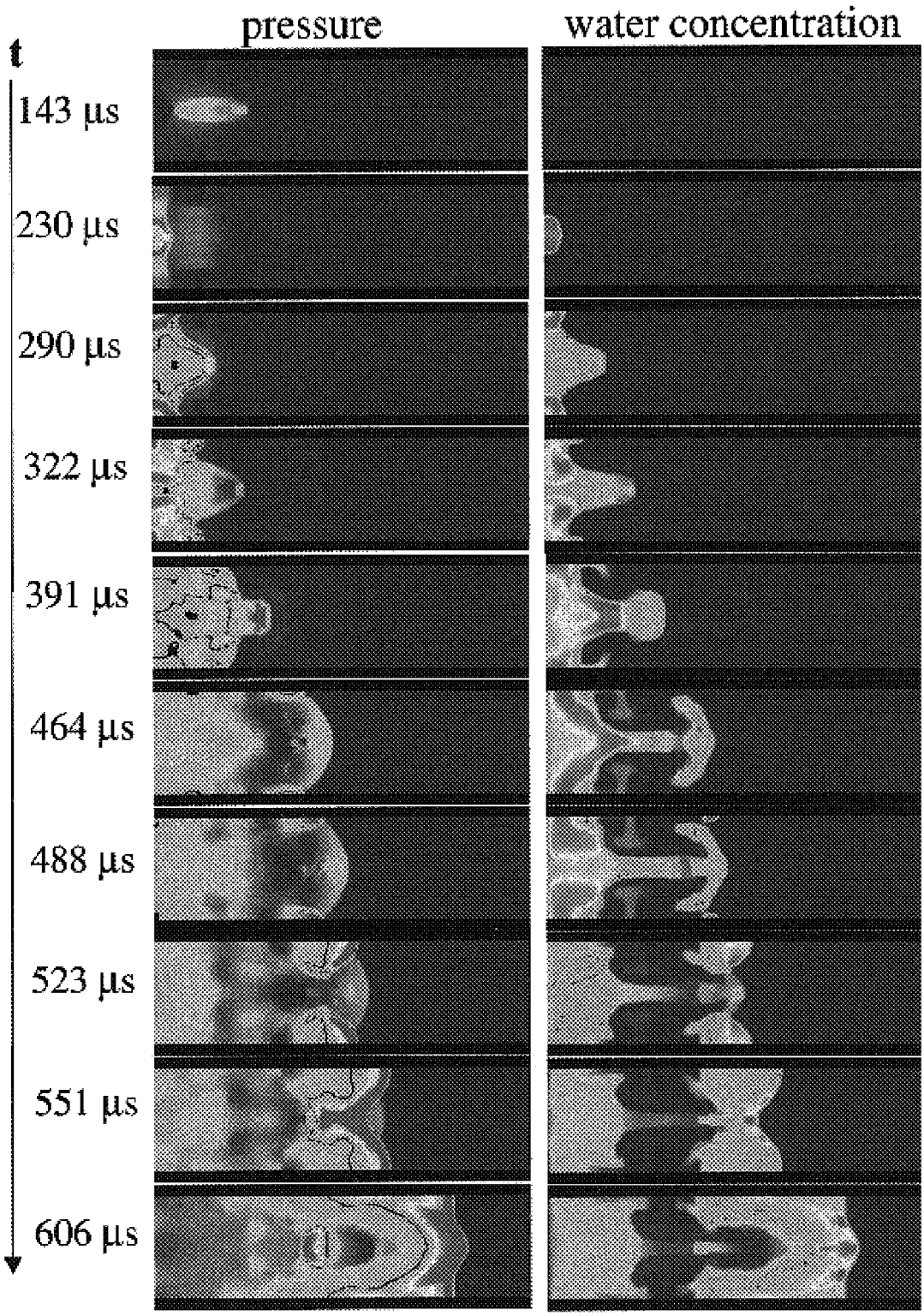
FIG. 17 illustrates incremental progression of detonation initiation to 606 $\mu$s by side-wall reflection of shock waves with the design of FIG. 12 using three jets of alternating air and fuel (ethylene) at pressure of 2.1 bars, temperature of 360 K and at a velocity of Mach number of unity.

In the case of the jet pressure of 2.1 bars shown in FIG. 17, even the combined strength of the initial and end-wall reflected shock waves was not enough to generate detonation. However, detonation was finally initiated by the reflected shock waves from the side tube wall at a very late time of 551 μs. In this case, it took repeated heating by the original imploding shock, the end-wall and side-wall reflected shocks to generate the detonation.

More specifically, at 143 μs, there is an appearance of a high-pressure kernel but no water, indicating lack of combustion. The first appearance of the end-wall reflected shock waves is at 230 μs. Initiation of the detonation is first observed near the side wall at 523 μs. The detonation initiated near the side wall expands toward the tube center and forms a continuous detonation front covering the entire cross-section of the tube at 551 μs.

Figure 18:
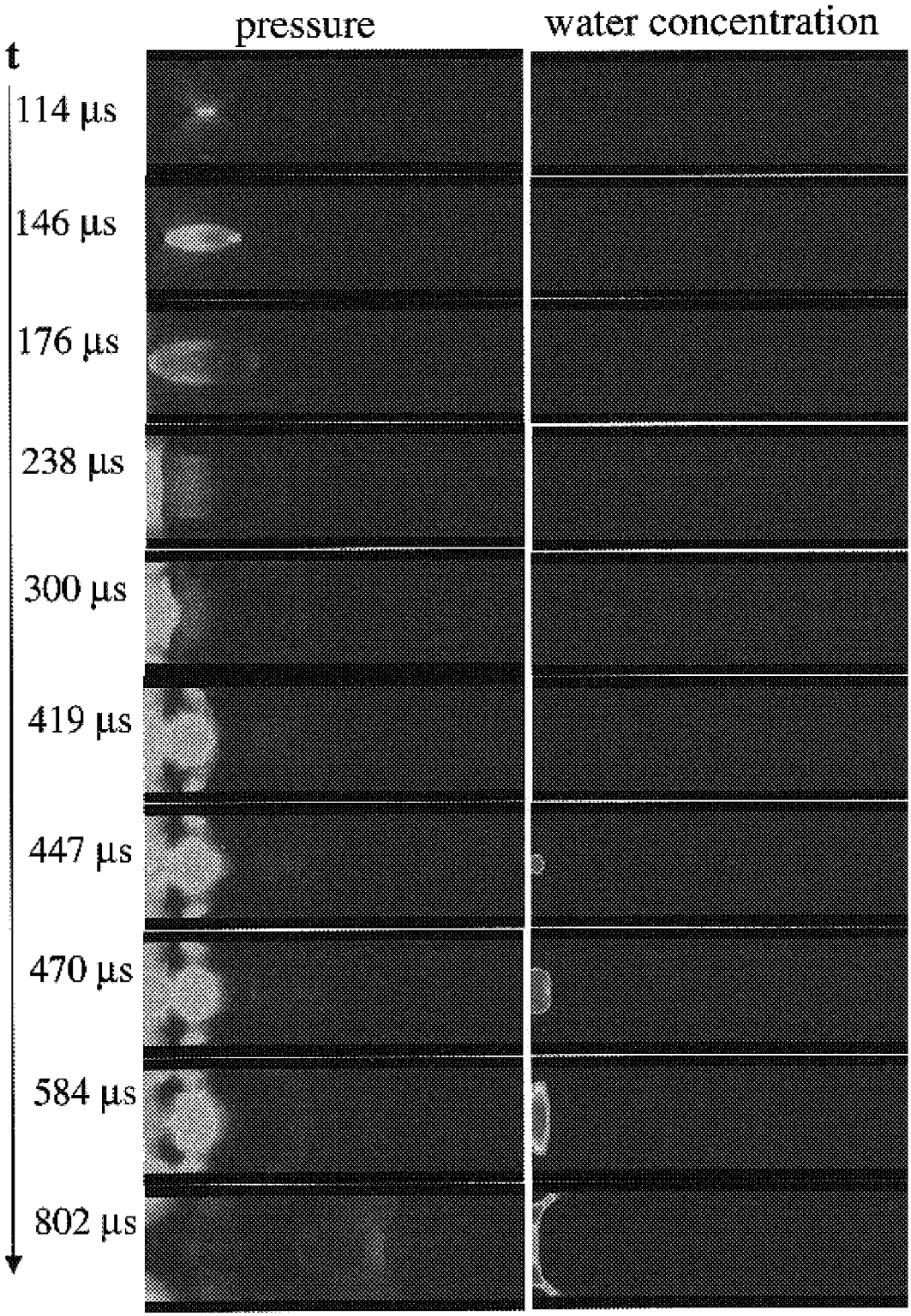
FIG. 18 illustrates insufficient detonation initiation to 802 $\mu$s with the design of FIG. 12 using three jets of alternating air and fuel (ethylene) at pressure of 2.0 bars, temperature of 360K and at velocity of Mach number of unity.

In the case of the jet pressure of 2.0 bars, shown in FIG. 18, detonation was not achieved even with the combined effect of the initial imploding shock and end wall and side wall reflected shocks. More specifically, at 114 μs shown in FIG. 18, the imploding shock created by the impinging jets forms a high-pressure kernel with no formation of combustion product water. It is not until frame 447 μs, that some water forms on the end-wall but there is no coupling between water and the shock waves to produce a detonation. At the 802 μs frame, the shock is more than half way through the tube, but combustion is confined to a small region near the end wall, indicating lack of coupling between the shock and water formation, which is required for detonation initiation.

At a temperature below 360 K, such as 250 K, which corresponds to a total temperature of about 300 K, i.e., the temperature and pressure needed in the holding tank for maintaining required jet condition, with other conditions remaining the same, the minimum jet pressure for detonation initiation by reflected shock waves rose to 2.5 bars. The minimum jet pressure for direct jet detonation initiation increased to 2.7 bars. Detonations can be initiated using a single air jet normal to the tube wall, at the jet pressure of 2 bars and jet temperature of 250K. Actually, with a single air jet normal to the tube wall and the jet temperature of 250K, successful detonation initiation can be achieved as long as the jet pressure is greater that 1.5 bars. Apparently, the benefit derived from the additional combustion is outweighed by the loss in jet momentum associated with the angled jets. However, the benefit from the combustion of the jet material may be greater if some other jet materials and configurations are used. However, it is clear that, in either case, the required jet pressure for detonation initiation is well within practical engineering reach.

This invention has been extensively validated using numerical simulations. The jet velocity should be above Mach 1.0 to ensure the formation of imploding shocks. The jet pressure can range widely from slightly above 1 bar to whatever the structure and the jet handling system can withstand. Likewise, the jet temperature can also vary widely from less than room temperature up to whatever the system can bear. As long as the minimum jet pressure and temperature are satisfied, the detonation can be successfully initiated. In the studied cases, with a stoichiometric ethylene-air mixture, the minimum jet pressure can be as low as 1.5 bars and the minimum jet temperature can be as low as 250K which correspond to the total or tank pressure of less than 3 bars and the tank temperature of 300K, which is about room temperature. These pressure and temperature levels are readily achievable through commonly available engineering means. With properly chosen jet conditions, this method is expected to initiate detonation in practical aviation fuel mixtures in combustion chambers of practical sizes, especially for pulse detonation engines to be used in tactical missiles, with its size typical ranging from about 2 cm to 100 cm in diameter and with slot widths range approximately from 0.5 cm to 10 cm.

Generally, typical temperature and pressure in the jet impinging region in the chamber during the detonation initiation process are 1,500 to 5,000 K, and 30 to 300 bars, respectively. The chamber is typically metallic, such as titanium or steel, or it can be of any other material, such as ceramic, that can withstand the conditions, especially temperature and pressure. When the chamber is metallic, its thickness is typically 0.2 to 5 cm.

This invention provides an effective, simple and reliable method and apparatus to initiate detonation in conventional combustible materials used in pulse detonation engines and other detonation-based devices, while with those combustible materials, traditional initiation methods have great difficulties. Comparing to the existing initiation methods, this method appears particularly attractive because of the following important advantages: no additional parts are needed to be placed inside the pulse detonation engine tube; no fuel additives, such as oxygen or highly energetic hydrocarbons, are required; and no energy-depositing devices, such as spark plugs or lasers and related electric and electronic systems, are needed While presently preferred embodiments have been shown of the novel apparatus and method for initiating detonations in combustible materials, and of the several modifications discussed, persons skilled in this art will readily appreciate that various additional changes and modifications can be made without departing from the spirit of the invention as defined and differentiated by the following claims.

What is claimed is:

1. A method for initiating detonation in a combustible material comprising the step of injecting a jet material into a chamber filled with the combustible material from different directions to create a jet impinging region; generating imploding shocks that increase temperature and pressure in the jet impinging region to the point of initiating detonation in the combustible material without using a separate ignition source of another type.

2. The method of claim 1 including the step of starting injection of the jet material when the detonation initiation process begins and stopping the injection of the jet material after the detonation is initiated.

3. The method of claim 1 wherein the step of injecting the jet material into the chamber from different directions is discontinuous in the sense of injecting through holes in the chamber.

4. The method of claim 1 wherein the step of injecting the jet material into the chamber from different directions is continuous in the sense of injecting through at least one annular slot around the chamber.

5. The method of claim 4 wherein said step of injecting the jet material includes the step of injecting a fuel through an opening in the chamber and injecting an oxidant through jet openings disposed on the sides of the fuel opening.

6. The method of claim 5 wherein the fuel is ethylene and the oxidant is oxygen.

7. The method of claim 1 wherein the jet material is gaseous.

8. The jet material of claim 7 wherein the gaseous jet material is air.

9. The method of claim 8 wherein pressure and temperature in the jet impinging region necessary for detonation initiation is from 20 bars to 1000 bars and from 1,500 K to 5,000 K, respectively.

10. The method of claim 7 wherein said step of injecting air includes the step of injecting air through an opening.

11. The method of claim 7 wherein typical pressure and temperature in the jet impinging region necessary for detonation initiation is from 20 bars to 1000 bars and from 1,500 K to 5,000 K, respectively.

12. An apparatus comprising a chamber that can be filled with a combustible material; a filling port for admitting the combustible material into the chamber; means for admitting jet material into the chamber from different directions to create a jet impingement region where imploding shocks are generated for detonation initiation without using a separate ignition source of another type; and an exit opening in the chamber for allowing combustion products from detonation initiation to exit the chamber.

13. The apparatus of claim 12 wherein said chamber is tubular.

14. The apparatus of claim 13 wherein said chamber is metallic.

15. The apparatus of claim 13 wherein said at least one opening is a single circumferential slot around the chamber disposed at any location along the chamber.

16. The apparatus of claim 13 wherein the said at least one opening is a series of three closely spaced circumferential slots disposed at any location along the chamber.

17. The apparatus of claim 13 wherein chamber ID is 2–100 cm.

18. The apparatus of claim 13 wherein said at least one jet opening is disposed a distance from an end of said chamber that renders reflected shock waves ineffective in the initiation of detonation of the combustible material.

19. The apparatus of claim 13 including a holding tank for the combustible material, a conduit extending from said combustible-material holding tank to said chamber, a control valve for controlling flow rate through said conduit, and an electric control unit for controlling said control valve.

20. The apparatus of claim 12 wherein said chamber has a closed end at one end and is open at the other end through which combustion products exit.

21. The apparatus of claim 12 wherein said chamber is metallic up to about 2 cm. in thickness.

* * * * *